United States Patent [19]

Domes

[11] 3,957,141

[45] May 18, 1976

[54] BRIEFCASE

[76] Inventor: Norbert Domes, 111 Mountainview Road, North Balwyn, Victoria, Australia

[22] Filed: Sept. 25, 1974

[21] Appl. No.: 509,319

[30] Foreign Application Priority Data

Sept. 26, 1973 Australia ..... 5010/73

[52] U.S. Cl. ..... 190/42; 190/60; 150/1.6

[51] Int. Cl.[2] ..... A45C 15/00

[58] Field of Search ..... 190/60, 42; 150/1.5, 150/1.6

[56] References Cited

UNITED STATES PATENTS

| | | | |
|---|---|---|---|
| 1,399,752 | 12/1921 | Diamond | 190/60 |
| 1,976,698 | 10/1934 | Gihon | 190/51 |
| 2,806,711 | 9/1957 | Jacobs | 150/1.5 B |
| 3,188,046 | 6/1965 | Cervenka | 190/60 |

FOREIGN PATENTS OR APPLICATIONS

| | | | |
|---|---|---|---|
| 202,126 | 6/1939 | Switzerland | 190/60 |
| 14,543 | 10/1888 | United Kingdom | 190/60 |
| 304,826 | 4/1918 | Germany | 190/60 |
| 335,444 | 9/1930 | United Kingdom | 190/60 |
| 347,220 | 4/1931 | United Kingdom | 190/60 |
| 5,090 | 3/1891 | United Kingdom | 190/60 |

*Primary Examiner*—Ro E. Hart
*Attorney, Agent, or Firm*—Cushman, Darby & Cushman

[57] ABSTRACT

A briefcase having a compartment which is accessible from outside of the case and in which an umbrella may be housed. The compartment and umbrella having interengagable components such as thread formation to releasably retain the umbrella in the compartment.

6 Claims, 5 Drawing Figures

BRIEFCASE

Figures 1, 2, 3, 4, 5:
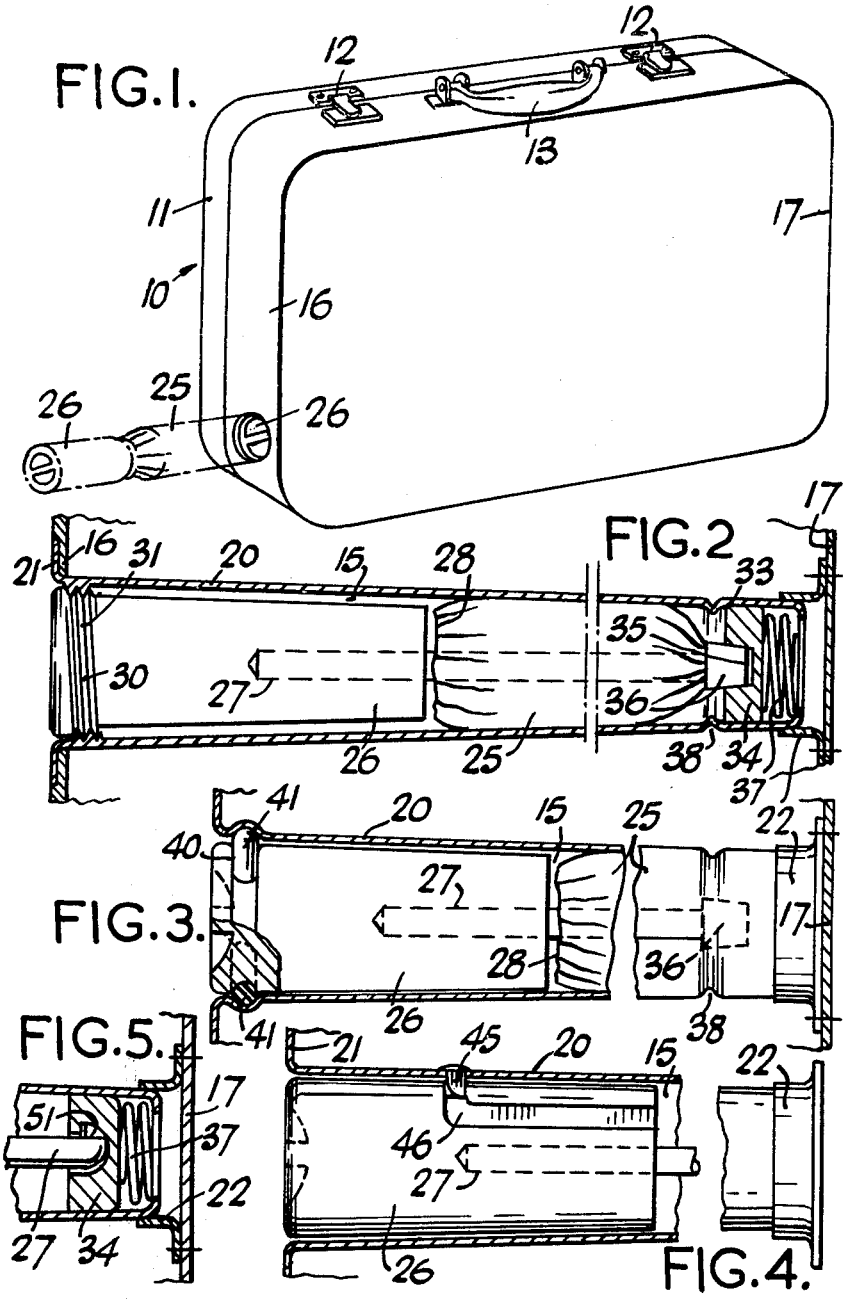

This invention relates to a briefcase specifically adapted for the carrying of an umbrella.

During winter months it is customary for salesmen, business representatives, and other people who are required to move from one building to another during their working hours, to carry an umbrella for protection in the event of unexpected rain. As such people normally also carry a briefcase, both of their hands are occupied in carrying these two articles, and thus they do not have a free hand to carry other articles or to carry out normal operations such as boarding buses or trains, buying tickets and the like. In addition, after the umbrella has been in use it cannot be conveniently folded and placed in the briefcase, as the rain on the umbrella may damage papers or other articles within the briefcase.

It is therefore the object of the present invention to provide in a briefcase, provision for carrying an umbrella so that both articles can be carried by one hand, and so that a wet umbrella will not damage articles within the briefcase.

With this object in view there is provided a briefcase including a separate compartment accessable from outside of the briefcase and adapted to receive an umbrella and permit insertion and removal thereof from outside the briefcase, and means to retain an umbrella received in the compartment.

Conveniently there is provided in combination with said briefcase an umbrella and the means to releasably retain the umbrella comprise complementary components on the briefcase and umbrella interengagable when the umbrella is received in the compartment.

More specifically there is provided a briefcase including a separate compartment preferably located within the confines of the interior of the case, an opening in the case communicating with said compartment, the opening and compartment being shaped and arranged to permit insertion into, and removal from, said compartment of an umbrella, a portion of the briefcase being adapted to interengage with the umbrella when the latter is inserted into the compartment to releasably retain the umbrella.

Conveniently the compartment extends into the interior of the briefcase from one end thereof and if located at or near one wall, preferably the bottom of the case. The compartments may be made of any suitable material provided it will prevent moisture on the umbrella damaging the contents of the briefcase. Also the compartment is preferably formed of a rigid or semi-rigid material so that the compartment will not become deformed or mis-shaped by the presence of articles within the briefcase. The compartment may be made of metal, for example aluminium, a rigid thermoplastic material, or another rigid material coated or impregnated to render it water-resistant.

The opening in the briefcase which provides access to the compartment may be formed with a threaded portion and the handle of the umbrella provided with a complementary threaded portion said portions being threadably engagable when the umbrella is inserted into the compartment, to thereby retain the umbrella within the compartment. In an alternative construction, the compartment in the briefcase and the umbrella handle may be provided with the complementary components of a bayonet-type coupling as a means of releasably retaining the umbrella within the compartment.

As the normal briefcase is not large enough to incorporate a compartment which would receive an umbrella of the non-telescopic type, it is envisaged that umbrellas employed in the practice of the invention will be of the now widely-known telescopic type, which reduce in length to approximately half the normal length of an umbrella.

The briefcase may be of the type comprising two substantially rigid tray-like sections hinged together along one side and carrying cooperating fastening devices on the opposite side. A suitable handle is also provided on this opposite side. In a preferred form of the briefcase the fastening devices and the handle are located within recesses in the tray-like sections so that there is normally no protuberances above the surface of the tray-like sections. To this end, the handle may be spring-loaded so as to withdraw into the recess when not in use.

The invention will be more readily understood from the following description of several practical arrangements of the invention as illustrated in the accompanying drawings. In the drawings FIG. 1 is a perspective view of the briefcase with the umbrella assembled thereto FIG. 2 is a sectional view through the lower portion of the briefcase into which the umbrella is fitted FIG. 3 is a view similar to FIG. 2 of an alternative construction FIG. 4 is a view similar to FIG. 2 of a further alternative construction FIG. 5 is a partial sectional view of yet a further construction.

Referring now to FIGS. 1 and 2, the briefcase 10 is generally of convention construction having a lid 11, fastenings 12 and a handle 13. The umbrella receiving compartment 15 is provided adjacent one longitudinal wall of the briefcase and extends between the two opposite end walls 16 and 17. The compartment 15 may be made of any suitable material such as a plastic moulding or extrusion, a metal tube, or any other suitable material and is preferably of a material that will not be damaged by water. In the embodiment shown the compartment 15 is formed by a tapered cylindrical tube 20 having a flange 21 at one end secured, such as by bonding, to the end wall 16 of the briefcase, and received at the other end in a socket 22 secured to the end wall 17 of the briefcase by bonding, rivoting or other suitable securing means.

The umbrella 25 is of generally conventional construction having a handle 26, a shaft 27 and a collapsible cover section 28 of any suitable known construction. The handle 26 of the umbrella is provided adjacent the end thereof with a thread formation 30 which may be engaged with a complementary thread formation 31 formed on the internal surface of the sleeve 20. When the two thread formations are engaged the umbrella is held within the compartment so that in use the umbrella cannot freely dislodge from the compartment.

In the end portion 33 of the compartment there is provided a locating member 34 having a cavity 35 to receive an enlarged end portion 36 of the shaft 27 of the umbrella. The locating member is urged by the spring 37 against the annular shoulder 38, and in that position is spaced from the thread formation 31 a distance so that when the umbrella is placed in the compartment 15 and the thread formations 30 and 31 fully engages, the spring 37 is further compressed from its normal condition. This results in an axial force being applied to the shaft of the umbrella to produce additional friction between the engaging thread formations to prevent accidental unscrewing.

Referring now to FIG. 3 the construction of the compartment 15 and the umbrella 25 are substantially the same as that previously described in respect of FIG. 2 except for the absence of the complementary thread formations 30 and 31. In this modification the handle 26 of the umbrella is provided with an annular recess 40 and a pair of oppositely disposed arcuate elements 41 are secured in the open end of the sleeve 20. The arcuate elements are preferably bonded in position and are made of a resilient material which may be compressed to facilitate entry and withdrawal of the umbrella with respect to the compartment 15. In a variation of this construction the recess 41 may be replaced by two oppositely located arcuate recesses in the handle 26 of the umbrella of a length equal to or slightly greater than the arcuate length of the elements 41. The remainder of the periphery of the umbrella handle, in the plane of the arcuate recesses, is of the normal contour of the handle so that upon rotation of the handle through approximately 180° the elements 41 are disengaged from the arcuate recesses and contact the plane surface of the umbrella to thereby permit withdrawal of the umbrella from the compartment. This alternative construction has the advantage of requiring less effort on the part of the user to axially withdraw the umbrella from the compartment 15.

The embodiments shown in FIGS. 4 and 5 employ a bayonet and socket type locking device to hold the umbrella in assembly. The embodiment shown in FIG. 4 employs a projection or pin 45 projecting inwardly from the wall of the sleeve 20, and an elongated slot 46 in the handle 26. The slot 46 extends from the inner end face 47 of the handle and at the opposite end is provided with a lateral extension so that when the umbrella is fully inserted into the sleeve 20, the handle may be rotated to a small degree so that the pin 45 is out of alignment with the slot 46, and thus the umbrella cannot be directly withdrawn from the sleeve 20. The embodiment shown in FIG. 4 also incorporates a locating plate 35 and spring 37 as shown in FIG. 2, and the arrangement of the pin 45 and lateral projection of the slot 46 are such that the spring must be compressed to permit the pin 46 to enter the lateral projection.

FIG. 5 shows a variation from the embodiment shown in FIG. 4 wherein a lateral projection or pin 51 is provided on the end of the umbrella shaft 27 remote from the handle which engages with a slot in the spring-loaded locating plate 52 in the manner of a bayonet and socket connection as previously described with reference to FIG. 4.

The claims defining the invention are as follows:

1. A briefcase and umbrella combination including a separate compartment adapted to house the umbrella, an opening in the briefcase communicating with said compartment and shaped and located to permit insertion into, and removal from, said compartment of the umbrella, a first locking element provided on the umbrella, and a second locking element provided on the briefcase, said first and second locking elements being arranged to interlock to retain the umbrella when housed in the compartment and releasable for removal of the umbrella.

2. The combination claimed in claim 1 wherein the locking elements comprise respective thread formations formed on the umbrella and briefcase.

3. The combination claimed in claim 1 wherein the locking elements comprise a pin and socket bayonet-type coupling with the pin formed on one end and the socket on the other one of the umbrella and briefcase.

4. The combination as claimed in claim 1 wherein the locking elements comprise an inwardly directed projection on the wall of the compartment, and a slot in the handle of the umbrella located so that the projection enters the slot as the umbrella is inserted into the compartment, said slot having a portion transverse to the direction of insertion of the umbrella arranged to receive the pin upon partial rotation of the umbrella after insertion into the compartment.

5. A briefcase and umbrella combination including a compartment formed by a hollow member located within the confines of the briefcase and secured to at least one wall of the briefcase, an opening in said wall communicating with the interior of the hollow member and shaped to permit insertion of the umbrella into the hollow member through said opening, and complementary elements on the hollow member and umbrella interengagable when the umbrella is inserted into the hollow member to releasably retain the umbrella within the hollow member.

6. The combination of a briefcase and an umbrella , said briefcase including separate compartment means for housing said umbrella, and opening means in said briefcase communicating with said compartment means for permitting said umbrella to be inserted into, and removed from, said compartment means, first locking element means provided on said umbrella, and second locking element means located on said briefcase, said first and second locking element means cooperating to releasably interlock to retain said umbrella in said compartment means.

* * * * *